US010619388B2

(12) United States Patent
Shah

(10) Patent No.: US 10,619,388 B2
(45) Date of Patent: Apr. 14, 2020

(54) DOOR LATCH WITH LOW OPERATING NOISE

(71) Applicant: ARCHITECTURAL BUILDERS HARDWARE MFG., INC., Itasca, IL (US)

(72) Inventor: Ankit Kirti Shah, Chicago, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 0 days.

(21) Appl. No.: 15/792,099

(22) Filed: Oct. 24, 2017

(65) Prior Publication Data

US 2018/0044955 A1 Feb. 15, 2018

Related U.S. Application Data

(63) Continuation of application No. 14/534,714, filed on Nov. 6, 2014, now Pat. No. 9,828,793.

(51) Int. Cl.

| | |
|---|---|
| ***E05C 1/06*** | (2006.01) |
| ***E05C 1/14*** | (2006.01) |
| ***E05B 17/00*** | (2006.01) |
| *E05C 1/08* | (2006.01) |
| *E05B 77/42* | (2014.01) |
| *E05B 77/36* | (2014.01) |

(52) U.S. Cl.

CPC ..... *E05C 1/14* (2013.01); *E05B 17/0045* (2013.01); *E05B 17/0041* (2013.01); *E05B 77/36* (2013.01); *E05B 77/42* (2013.01); *Y10S 292/56* (2013.01)

(58) Field of Classification Search

USPC ..... 292/143

See application file for complete search history.

(56) References Cited

U.S. PATENT DOCUMENTS

| | | | |
|---|---|---|---|
| 1,194,636 | A | 8/1916 | Joy |
| 1,620,414 | A | 3/1927 | Vanderlip |
| 2,029,711 | A | 2/1936 | Frantz |
| 2,073,149 | A | 3/1937 | Geyer |
| 2,125,655 | A | 8/1938 | Schlage |
| 2,159,315 | A | 5/1939 | Blue |
| 2,194,801 | A | 3/1940 | Lindstrom |
| 2,823,941 | A | 2/1958 | Ellis |
| 3,089,720 | A | 5/1963 | Schlage |
| 3,153,552 | A | 10/1964 | Sandor |
| 3,637,246 | A | 1/1972 | Leiter |
| 4,007,954 | A | 2/1977 | Erickson |
| 4,358,141 | A | 11/1982 | Hamada |
| 4,482,179 | A | 11/1984 | Johnson |
| 4,896,908 | A | 1/1990 | Kleefeldt |
| 4,986,583 | A | 1/1991 | Campbell et al. |
| 5,690,371 | A | 11/1997 | Turnbull |
| 5,730,478 | A | 3/1998 | D'Hooge |

(Continued)

*Primary Examiner* — Carlos Lugo

(74) *Attorney, Agent, or Firm* — Greer, Burns & Crain Ltd.

(57) ABSTRACT

A door latch assembly is provided with enhanced acoustic dampening characteristics, and includes a door bolt assembly having an inside barrel and an outside barrel configured for accommodating reciprocal sliding action of the inside barrel between a latch position and a release position. At least one barrel acoustic isolator is associated with at least one of the inside barrel and the outside barrel, and is configured for dampening sound generated by the reciprocal action.

10 Claims, 8 Drawing Sheets

(56) References Cited

U.S. PATENT DOCUMENTS

| | | | | |
|---|---|---|---|---|
| 5,862,570 | A | 1/1999 | Lezuch et al. | |
| 6,196,599 | B1 | 3/2001 | D'Hooge | |
| 6,293,598 | B1 | 9/2001 | Rusiana | |
| 6,570,757 | B2 | 5/2003 | DiFonzo et al. | |
| 7,258,374 | B2 | 8/2007 | Rusiana | |
| 7,481,607 | B2 | 1/2009 | Rusiana et al. | |
| 7,677,614 | B2 | 3/2010 | Mönig | |
| 7,841,632 | B2 | 11/2010 | Tracy et al. | |
| 7,866,714 | B2 | 1/2011 | Mönig | |
| 7,905,525 | B2 | 3/2011 | Badia | |
| 8,403,374 | B2 | 3/2013 | Shimizu et al. | |
| 8,491,020 | B2 | 7/2013 | Lopes | |
| 8,807,607 | B2 | 8/2014 | Glickman | |
| 9,828,793 | B2 * | 11/2017 | Shah | E05C 1/14 |
| 2009/0315342 | A1 | 12/2009 | Dalton, Jr. et al. | |
| 2010/0253101 | A1 | 10/2010 | Seto et al. | |
| 2012/0272697 | A1 | 11/2012 | Motherwell | |
| 2013/0076046 | A1 | 3/2013 | Shah et al. | |
| 2015/0021933 | A1 | 1/2015 | Shin et al. | |

* cited by examiner

DOOR LATCH WITH LOW OPERATING NOISE

CROSS-REFERENCE

The present application is a Continuation application of, and claims 35 USC 120 priority from U.S. patent application Ser. No. 14/534,714 filed Nov. 6, 2014, which is incorporated herein by reference.

BACKGROUND

The present invention relates generally to door latch assemblies that include a door bolt assembly operable by a door handle assembly preferably having a paddle style handle. The handles are selectively positionable in either in up, down, horizontal left or horizontal right configurations. More specifically, the present disclosure relates to a door latch assembly configured to operate with relatively low operating noise.

Examples of existing door latch, door bolt, and door handle assemblies are described in U.S. Pat. Nos. 6,293,598; 7,258,374; 7,481,607; 6,196,599 and 5,730,478, and US Patent Publication No. 2013/0076046A1, all commonly assigned to Architectural Builders Hardware Manufacturing, Inc., and hereby incorporated by reference. Such door latch assemblies include, generally, a door bolt assembly with a latch mechanism, and at least one handle mechanism.

A common problem of conventional door latch and door handle assemblies is that they generate more than desired levels of noise over the ambient noise. In some environments, such levels of noise may be distracting. For example, in hospital work environments, the opening of a patient's room door by a nurse may unnecessarily wake the patient, thereby inhibiting patient rest. In addition, in an operating room environment, a surgeon may be unnecessarily distracted by the opening of a door during a delicate procedure, thereby causing the surgeon to lose focus. Ambient noise in typical hospital work environments is about 40-42 decibels (dB). A conventional door latch and door handle assembly may generate over 30 additional decibels of noise when a door is opened.

SUMMARY

Thus, there is a need for an improved door latch assembly with door bolt and door handle assemblies designed for operating with relatively low operational noise, particularly in hospital and medical environments. This need is addressed by the present door latch assembly, which features acoustic isolators located between selected components, thus dampening sound generated when these parts make contact with each other while opening and closing a door.

More specifically, a door latch assembly is provided with enhanced acoustic dampening characteristics, and includes a door bolt assembly having an inside barrel and an outside barrel configured for accommodating reciprocal sliding action of the inside barrel between a latched position and a released position. At least one barrel acoustic isolator is associated with at least one of the inside barrel and the outside barrel, and is configured for dampening sound generated by the reciprocal action.

In another embodiment, a door latch assembly is provided with at least one barrel acoustic isolator associated with at least one of the inside barrel and the outside barrel, and configured for guiding the inside barrel in the outside barrel when accommodating the reciprocal sliding action of the inside barrel to reduce contact between the inside barrel and the outside barrel, thereby dampening sound generated by the reciprocal action.

In still another embodiment, a door latch assembly is provided with enhanced acoustic dampening characteristics including a door bolt assembly having an inside barrel and an outside barrel configured for accommodating reciprocal sliding action of the inside barrel between a latch position and a release position. At least one barrel acoustic isolator is associated with at least one of the inside barrel and the outside barrel, and configured for dampening sound generated by said reciprocal action. In addition, an anvil plate is secured inside the inside barrel and having a finger-receiving surface. The door latch assembly preferably includes a door handle assembly having a finger and a door handle coupled to the finger such that the finger moves laterally along the axis of the inside barrel when the door handle is moved from a rest position to an actuating position. In addition, the door handle assembly includes a finger acoustic isolator secured around the finger to retain the finger when the door handle is in the rest position and configured for dampening sound generated by the finger moving laterally along the axis of the inside barrel. Further, the inside barrel is configured for receiving the finger of using the finger-receiving surface of the anvil plate.

In still another embodiment, a door latch assembly is provided enhanced acoustic dampening characteristics, includes a door bolt assembly including a latch cylinder having a latch cylinder opening and a reciprocating strike, and a door handle assembly. The door handle assembly has a finger and a door handle coupled to the finger such that the finger is moved in the latch cylinder opening when the door handle is moved from a rest position to an actuated position, the finger is configured for biasing the latch cylinder from a latch position to a release position. The door latch assembly is constructed and arranged to generate between 0.01 and 15 decibels over ambient noise.

DETAILED DESCRIPTION

Figure 1:
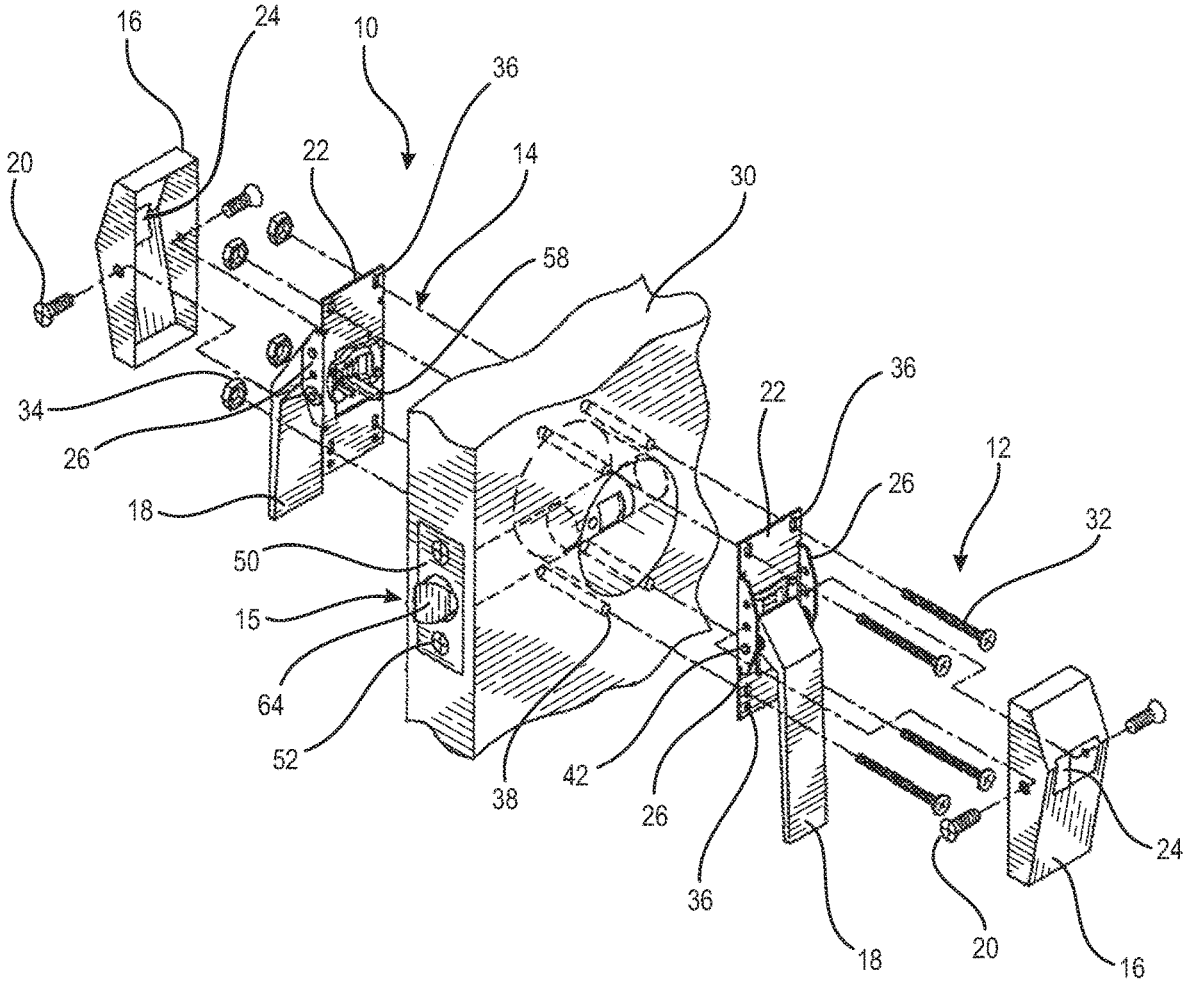
FIG. 1 is top exploded perspective view of the present door latch assembly shown mounted on a door.
Figure 3:
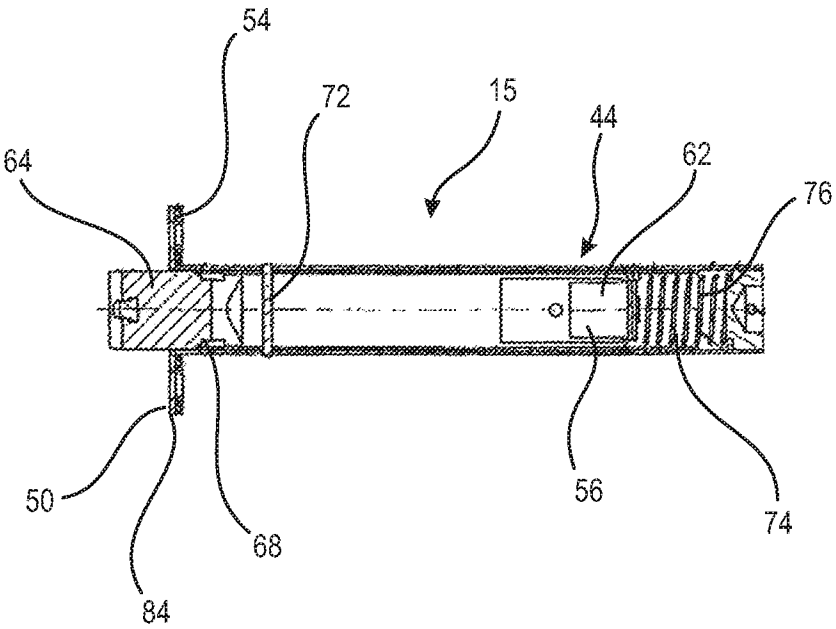
FIG. 3 is a vertical cross-section taken along the line 3-3 of FIG. 2 and in the direction generally indicated.
Figure 2:
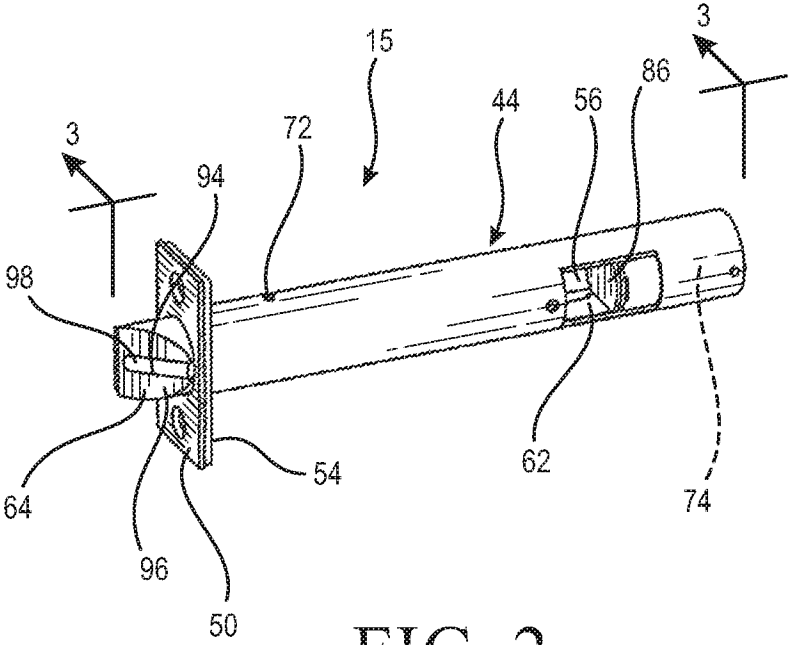
FIG. 2 is a side perspective view of the present door bolt assembly.
Figure 4:
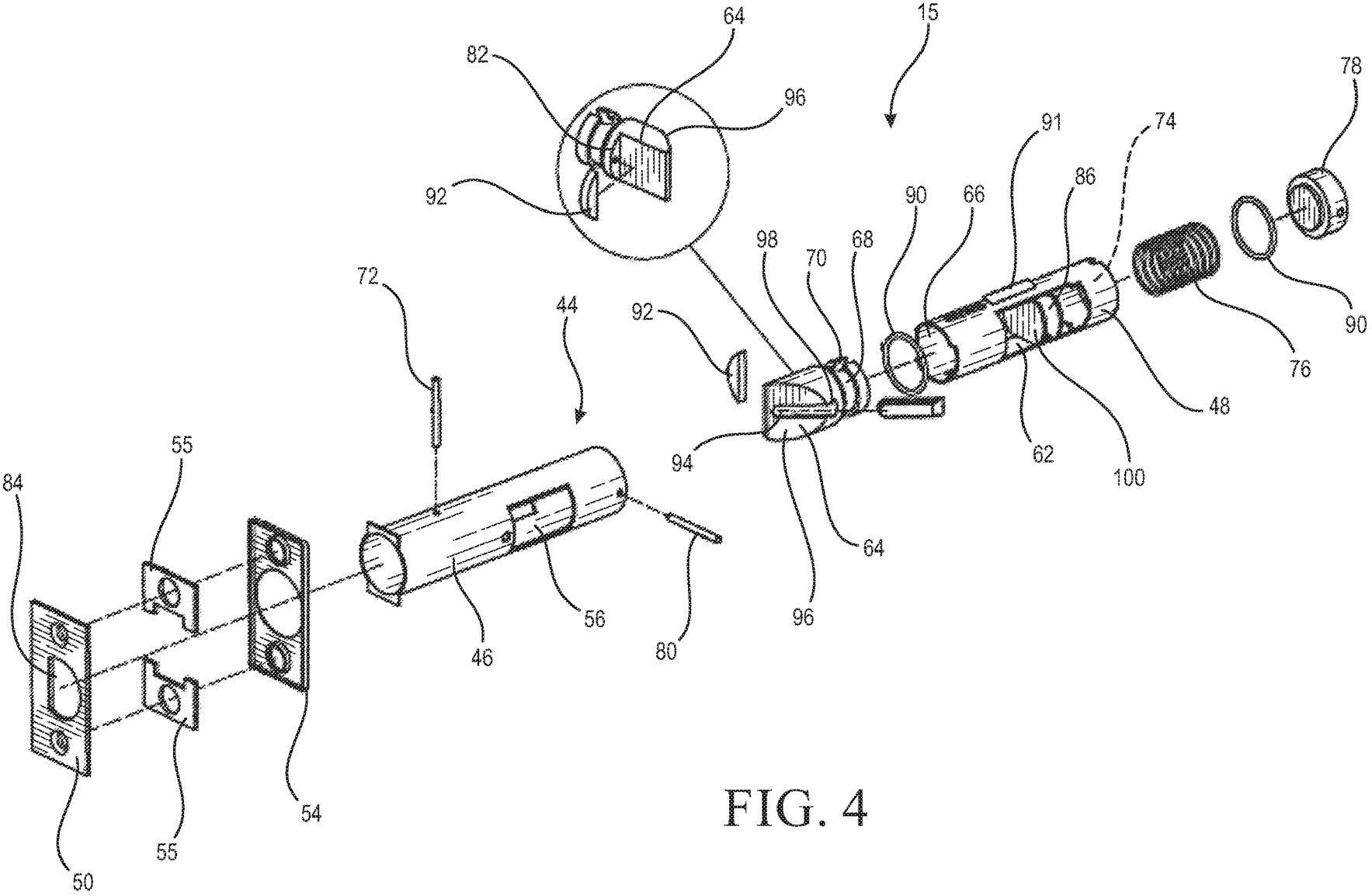
FIG. 4 is an exploded perspective view of the present door bolt assembly.

Referring now to FIG. 1, the present door latch assembly is shown and generally designated 10. The door latch assembly 10 includes door handle assemblies 12 and 14 as well as a door bolt assembly 15. Each door handle assembly 12, 14 is identical, and as such only one will be described in detail. Included in the door handle assembly 12 is a faceplate or cover plate 16, a door handle 18, and at least one faceplate fastener such as a screw 20 used for securing the faceplate to a mounting plate 22. Further, each faceplate 16 has a faceplate opening 24 that is configured to allow the door handle 18 to pass through for actuation by a user. FIG. 1 shows each faceplate opening 24 being rectangular in shape, however, persons of ordinary skill in the art would understand that other shapes are contemplated.

In addition, each faceplate 16 is secured to sidewalls 26 of the mounting plate 22 using the faceplate fasteners 20. Moreover, each door handle 18 is configured to be also pivotably secured to a corresponding mounting plate 22. Further, each door handle 18 is configured for movement between a rest position and an actuating position to open the door by actuating (lifting or pressing) the door handle about a pivoting point described below.

The door handle assemblies 12, 14 are secured to a door 30 by a plurality of mounting fasteners, such as bolts 32 and associated mounting nuts 34. Further, each mounting plate 22 has a plurality of mounting openings 36 configured for being in registry with associated mounting openings 38 on the door 30. The mounting bolts 32 are passed through the mounting plate openings 36 then through the door mounting openings 38 and the mounting openings of the other mounting plate. As is known in the art, the mounting bolts 32 are then secured using the mounting nuts 34.

A shaft 42 (Best seen in FIG. 5) is configured to pass through a selected pair of corresponding aligned openings in the sidewalls 26. The pivot pin 42 also passes through a complementary bore in the door handle 18 and maintains pivoting action and alignment of the door handle 18 relative to the mounting plate 22. A torsion spring (not shown) is located on the pivot pin 42 and is configured for returning the door handle 18 to the rest position when released. As is known in the art, he torsion spring is preferably U-shaped with coiled spring-shaped side portions, a horizontal bottom portions and a pair of legs. Each of the spring-shaped side portions is configured for wrapping around the pivot pin 42, on opposite sides of the door handle 18.

Referring now to FIGS. 1-4, while other configurations are contemplated, the door latch assembly 10 is preferably a so-called "low profile" design as is well known in the art. Included in the assembly 10 is the door bolt assembly 15 including a latch cylinder 44 made up of an outside barrel 46 and an inside barrel 48 reciprocating within the outside barrel between a latched and a released or retracted position. Also included on the outside barrel 46 is a dress plate 50 at one end of the cylinder. At least one dress plate fastener 52 passes through the dress plate 50 and an underlying back plate 54 for attaching the door bolt assembly 15 to the door 30. If desired, spacers 55 are located between the back plate 54 and the dress plate 50.

Figure 5:
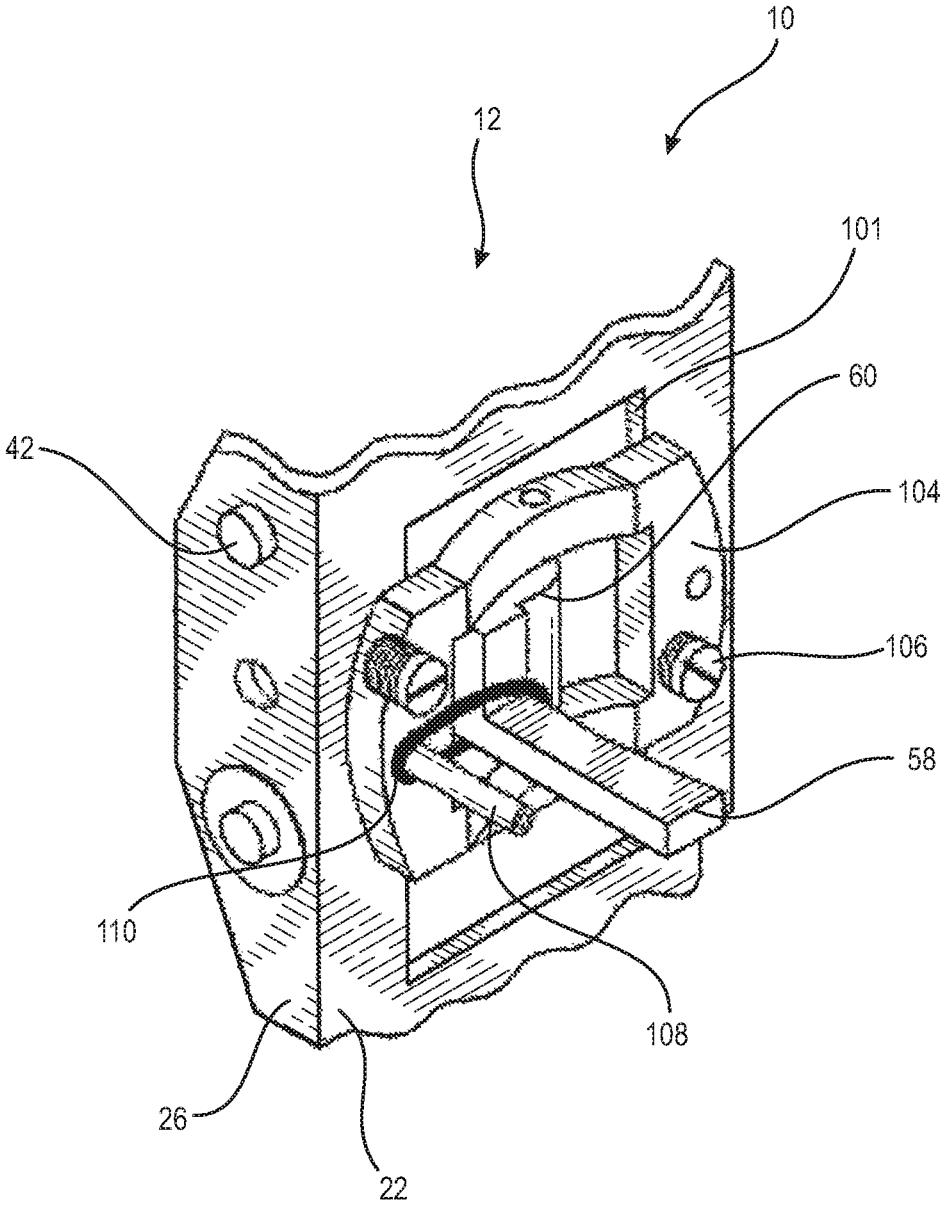
FIG. 5 is an enlarged fragmentary rear perspective view of the present mounting plate.

Included on the latch cylinder 44 is a latch cylinder opening 56 configured to receive a finger 58 of the door handle assembly 12. The finger 58 is attached to a pivoting cam 60 (FIG. 5). While in the preferred embodiment, the finger 58 and the cam 60 are integrally formed, as by casting, other fabrication techniques, including separate finger and cam attached during assembly, are contemplated. On the inside barrel 48, a corresponding inside barrel opening 62 is in registry with the latch cylinder opening 56 when the bolt assembly 15 is in the latched or rest position. Movement of the finger 58 in the openings 56, 62, causes the inside barrel 48 to laterally slide relative to the outside barrel 46 and open the latch to a released or retracted position by retracting a strike 64 relative to the dress plate 50. It has been found that the sliding movement of the inside barrel 48 relative to the outside barrel 46 is one source of the objectionable noise levels of conventional door latch assemblies.

More specifically, the strike 64 is held in place by being crimped into an open end 66 of the inside barrel at the point of an annular groove 68. The strike 64 also includes a groove 70 constructed and arranged to accommodate a roll pin 72 used to attach the inside barrel 48 to the outside barrel, at the same time accommodating movement of the inside barrel between the latched and a retracted position.

Opposite the strike 64, the inside barrel 48 defines a spring recess 74 dimensioned for accommodating a return spring 76 which biases the inside barrel 48 to the latched position in which the strike 64 projects from the door 30 as seen in FIG. 1. The spring 76 is held in place by engaging an end plug 78 that is in turn secured to an end of the outside barrel 46 using a spring roll pin 80. In the extended position of the strike 64, a recessed shoulder 82 of the strike engages an inside surface 84 of the dress plate 50 to define a farthest extent of the extension of the inside barrel 48 relative to the outside barrel 46. Contact of the strike shoulder 82 against the dress plate 50 has been found to be another source of excessive noise generated by conventional door latch assemblies.

In addition, an anvil plate 86 is fixed to the inside barrel 48 and defines one end of the inside barrel opening 62, and also retains the return spring 76 in the spring recess 74 opposite the end plug 78. As is known in the art related to low profile latch assemblies, the finger 58 of the door handle assembly 12 moves laterally along the axis of the inside barrel 48 within the inside barrel opening 62 when the door handle 22 is moved from the rest position to the actuating position. The finger 58 makes contact with the anvil plate 86 when moving laterally, overcoming the biasing action of the return spring 76 and retracting the strike 64 along with the rest of the inside barrel 48. In addition to the other sources described above, it has been found that noise is also generated through the action of the finger 58 against the anvil plate 86.

Referring again to FIG. 4, as discussed above, it has been recognized that a problem of conventional door latch and door handle assemblies, particularly the low profile type, is that they generate relatively excessive noise over the ambient noise. A feature of the present door latch assembly 10, is one or more acoustic isolators that dampen sound generated by different parts of the door latch assembly. In general, the acoustic isolators are positioned to acoustically isolate points of contact.

In the preferred embodiment, the door bolt assembly 15 includes several acoustic isolators. At least one barrel acoustic isolator 90 is disposed on the inside barrel 48 for isolating sound generated by the reciprocating action of the inside barrel. Preferably, a pair of isolators 90, which in the preferred embodiment are O-rings made of rubber or other known resilient material, are placed at or near each end of the inside barrel 48. More preferably, one isolator is placed near the junction of the strike 64 and the inside barrel 90. At the opposite end of the inside barrel 48, a second isolator 90 is placed at the junction of the end plug 78 and the inside barrel. The isolators 90 reduce the contact between inside barrel 48 and the outside barrel 46. In addition, the isolators 90 guide the reciprocating movement of the inside barrel 48 relative to the outside barrel 46 between the latch and release positions, and maintain a slight separation between the two barrels, in the general range of 0.020 inch, which may vary to suit the application.

In addition, the acoustic isolators alternately include one or more stabilizers 91, each of which is disposed exteriorly on the inside barrel 48 to reduce respective sliding contact between the outside barrel 46 and inside barrel. In one embodiment, the stabilizers 91 are polymeric spacers fixed to the inside barrel 48 to project radially from the inside barrel exterior and a pair of the stabilizers are diametrically located on the exterior of the inside barrel 48. The shape, number and position of the stabilizers 91 may vary to suit the situation, and, similarly to the isolators 90, are configured for reducing the area of contact made between the inside barrel 46 and the outside barrel 48, and thus dampening the sound generated by the present door latch assembly 10.

Also included on the door bolt assembly 15 is a strike acoustic isolator 92. This generally "D"-shaped component 92 is also made of rubber or similar resilient material, and is fixed, by chemical adhesive or the like, in the recessed shoulder 82 of the strike. Thus, the strike acoustic isolator 92 will contact the dress plate 50 to acoustically isolate these components. To further reduce noise of the strike 64, a strike pad 94 is held in place on an angled surface 96 of the strike in a pad groove 98, using a dovetail configuration with or without chemical adhesive, as is known in the art. The strike pad 94 is preferably made of nylon, rubber or other resilient, durable material.

Another acoustic isolator 100 is designated an anvil acoustic isolator, and is positioned on the anvil plate 86 within the inside barrel opening 62. The isolator 100 is held in place with chemical adhesive or the like, and is made of rubber or other suitable material. As such, the anvil acoustic isolator 100 receives the finger 58 and thus isolates the finger from the anvil plate 86.

Figure 6:
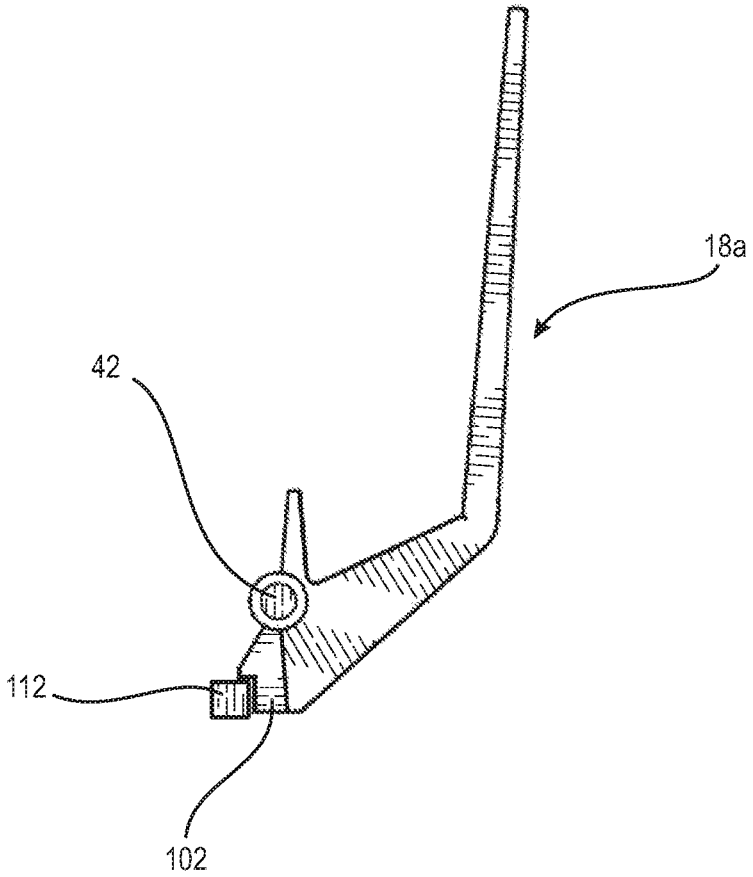
FIGS. 6-7 are side views of a pull door handle suitable for use with the present latch assembly.

Referring now to FIGS. 1, 5 and 6, the finger 58 protrudes substantially perpendicularly to a main plane defined by the mounting plate 22. As is known in the art, the finger 58 also includes the cam 60 activated by motion of the door handle 18 so that the finger moves in a lateral or side-to-side motion. Further, the cam 60 is at least partially disposed in a main mounting plate opening 101. During operation of the door handle assembly 12, the door handle 18 is either pushed or pulled, depending on the needs of the application. When the door handle 18 is in operation, an actuation end 102 of the door handle 12 engages the cam 60, causing the finger 58 coupled to the cam to move laterally along the longitudinal axis of the latch cylinder 44 within the latch cylinder opening 56 and the inside barrel opening 62, engaging the latch cylinder 56 such that the strike 64 is retracted and the door 30 can be opened.

A screw plate 104 is secured to the mounting plate 22 using fasteners 106. The screw plate 104 holds the cam 60 in position in the mounting plate opening 101. A pin 108 is coupled to, and protrudes from, the screw plate 104 and is substantially parallel to the finger 58 when the finger is in the rest position as seen in FIG. 5, which represents the latched position of the door bolt assembly 15. In conventional door latch assemblies, when the door handle 18 moves back and forth from the actuating position to the rest position thereby causing the finger 58 to move laterally, the finger may generate sound by making contact through movement relative to the screw plate 104. Thus, the present door handle assembly 12 includes a finger acoustic isolator 110 associated with, and preferably secured around the finger 58 as well as the pin 108. Other connections between the isolator 110 and the finger 58 are contemplated. By biasing the finger 58 relative to the screw plate 104 in any direction, the finger acoustic isolator 110 dampens sound generated by the finger 58 moving loosely or laterally along the axis of the inside barrel 48. In other words, the finger acoustic isolator 110 prevents unwanted vibration or movement of the finger 58 relative to the screw plate 104. In the preferred embodiment, the finger acoustic isolator 110 biases the finger 58 laterally or towards, or in the direction of the pin 108, however other biasing directions are contemplated. In the event the pin 108 is absent, it is also contemplated that the finger acoustic isolator 110 is anchored on another portion of the screw plate 104 or other attachments to the screw plate. In the preferred embodiment, the finger acoustic isolator 110 is an O-ring made of rubber or any other resilient material with similar properties. Other types of biasing devices, including but not limited to springs or loop-type biasing members are contemplated as the finger acoustic isolator 110.

Figure 7:
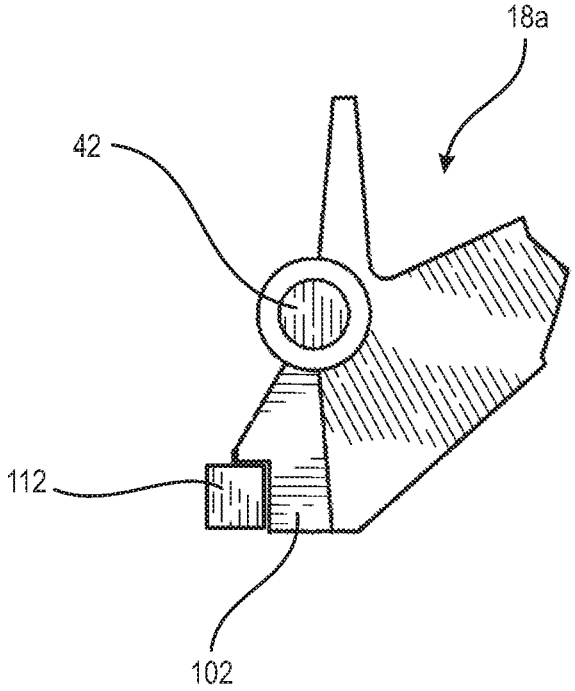

Referring to FIGS. 6-7, an embodiment of a door handle 18 of the pull type is designated 18*a* is shown that can be used in the door handle assembly 12. The pull handle 18*a* is coupled to the pivot pin 42 as described above, which is also secured to the mounting plate 22. Further, the pull handle 18*a* has the actuation end 102 engaging the cam 60. It has been found that a still further source of excessive noise is generated when the handle 18*a* strikes the mounting plate 22 upon release by the user. Accordingly, another acoustic isolator is provided in the form of a block-like handle isolator 112 secured, as by mechanically, chemical adhesive or the like, to the handle 18*a*. The handle acoustic isolator 112 is preferably made of rubber or similar resilient material.

Figure 8:
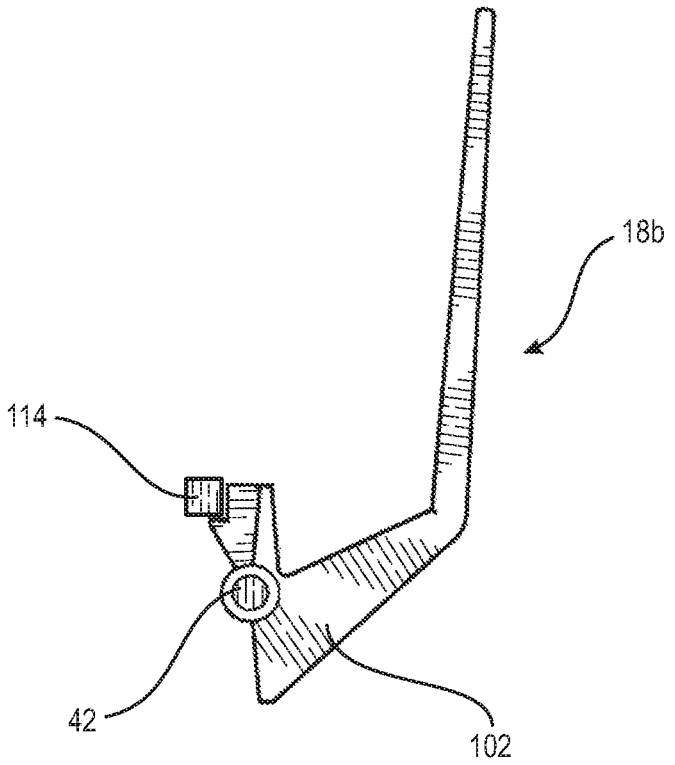
FIGS. 8-9 are side views of a push door handle suitable for use with the present latch assembly.
Figure 9:
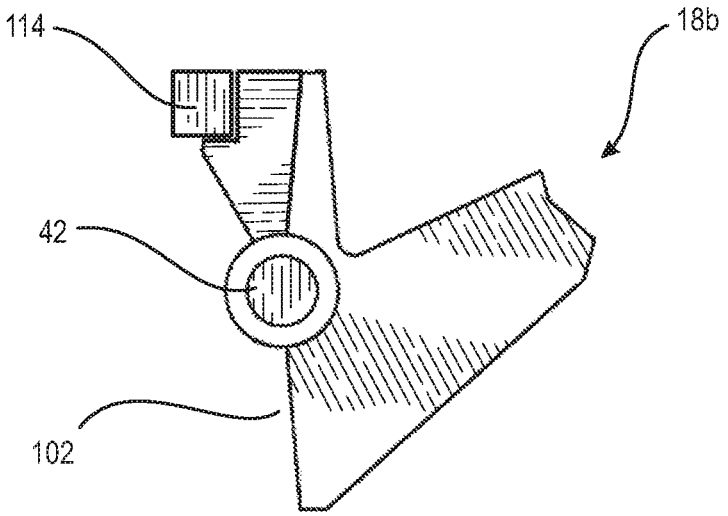

Referring now to FIGS. 8-9, an embodiment of door handle 18 in a push-type style is designated 18*b*. Shared components with the hands 18 and 18*a* are designated with identical reference numbers. A handle acoustic isolator 114 similar, if not identical in construction and orientation to the isolator 112 is secured to the push handle 18*b* and is configured to dampen sound generated by the push handle moving between the rest position and actuating position thereby making contact with the mounting plate 22.

The acoustic isolators 90, 92, 94, 100, 110, 112 and 114 of the door latch assembly 10, individually or in combination, dampen sound generated by the door latch assembly such that an increase in sound over ambient noise (which can range from 40 to 42 decibels) is substantially reduced compared to conventional latch assemblies, which add up to 30 decibels over ambient noise in a hospital room.

One of ordinary skill in the art may characterize ambient noise level (also called background noise level, reference sound level, room noise level, etc.) as the background sound pressure level at a given location, normally specified as a reference level to some other new intrusive sound source. In addressing one of the goals of the present latch, to reduce operational noise of door latches, the noise introduced by the present latch assembly 10 was measured to determine a level of sound introduced over the ambient noise level. Such test measurements were conducted in 50 increments of 10 second intervals on depression and spring back of the paddle of a test door handle (the total test lasting 9.6 minutes). Test measurements were performed using a plunger activation device, a Koolertron Digital Sound Level Meter, and a fixed mounting board for the tested door latches. In addition to measuring the noise introduced by the present latch assembly 10, sound level measurements of conventional latches were also measured.

The test results disclosed that the mean ambient sound level was 44.172 decibels, ranging from about 41 decibels to about 46 decibels. The mean sound level of the noise over ambient introduced by the present latch assembly 10 is about 0.01 decibels. In contrast, conventional door latch assemblies introduced a mean sound level of noise over ambient from about 29 to about 35 decibels. Embodiments of the present door latch assembly 10 were shown to dampen sound generated by movement of the door latch assembly to about 15 decibels to 0.01 decibels over the ambient noise level. Further embodiments dampen sound generated by movement of the door latch assembly ranged from about 10 decibels to 0.01 decibels over the ambient noise level. Additional embodiments dampen sound generated by movement of the door latch assembly ranged from about 5 decibels to 0.01 decibels over the ambient noise level.

The test measurements also found that the acoustic isolators of the door latch assembly 10, individually or in combination, dampen sound generated by the door latch assembly such that an increase in sound over the ambient noise level (which can range from 40 to 45 decibels) is less than about 37% to 0.022% of the ambient noise level. It is also contemplated that the increase over ambient noise by the operation of the present latch assembly 10 is about 25% to 0.022%. It is further contemplated that the increase over ambient noise by the operation of the present latch assembly 10 is about 12% to 0.022%. While particular embodiments of the present door latch assembly with low operating noise has been described herein, it will be appreciated by those skilled in the art that changes and modifications may be made without departing from the invention in its broader aspects and as set forth in the following claims.

The invention claimed is:

1. A door latch assembly with enhanced acoustic dampening characteristics:

said door latch assembly including at least one door handle assembly connected to a door bolt assembly, said door handle assembly including a pivoting handle, said door bolt assembly including:

an inside barrel;

an outside barrel configured for accommodating linear reciprocal sliding action of the inside barrel between a latch position and a release position caused by movement of said at least one handle assembly acting against a biasing force created by a return spring connected to said inside barrel, said pivoting handle movement causing reciprocal movement of a strike connected to said inside barrel for said sliding action relative to said outside barrel;

an end plug secured to the outside barrel for retaining the spring;

a first barrel acoustic isolator disposed on said strike and in contact with said inside barrel and an opposed second barrel acoustic isolator disposed on said end plug and in contact with said spring, said barrel acoustic isolators are configured to isolate sound generated by said reciprocal action of said inside barrel relative to said outside barrel;

said first barrel acoustic isolator being in direct contact with each of said inside barrel and said outside barrel;

said return spring retained in the inside barrel for biasing the inside barrel relative to the outside barrel in the latch position;

said strike coupled to the inside barrel and having a shoulder recessed from an end of said strike;

a dress plate coupled to the outside barrel and disposed for receiving the strike, such that engagement of said shoulder against said dress plate defines the farthest extension of said strike;

a strike acoustic isolator secured to the shoulder and configured for dampening sound generated by the strike making a generally planar contact which stops said linear reciprocating movement with said dress plate;

the door handle assembly including:

a finger; and said pivoting door handle coupled to the finger such that the finger moves laterally along the axis of the inside barrel when the door handle is moved from a rest position to an actuating position;

the door bolt assembly includes:

an anvil plate coupled to the inside barrel for moving the inside barrel to a release position against a biasing force generated by said return spring; and an anvil acoustic isolator fastened to a finger-receiving surface of the anvil plate and configured for receiving an end of said finger and dampening sound generated by the finger making contact with the anvil acoustic isolator, said finger moving laterally along a longitudinal axis of said inside and outside barrels and impacting said anvil through said anvil acoustic isolator for retracting said strike.

2. The door latch assembly of claim 1, further comprising:

a finger acoustic isolator associated with the finger and configured for dampening sound generated by the finger moving laterally along the axis of the inside barrel.

3. The door latch assembly of claim 1, further comprising a door handle assembly including:

a mounting plate; and a door handle pivotably attached to the mounting plate;

a handle acoustic isolator secured to the door handle and configured for dampening sound generated by the door handle making contact to the mounting plate when moving from at least one of a rest position to an actuating position and the actuating position to the rest position.

4. The door latch assembly of claim 1, wherein the at least one of the at least one barrel acoustic isolators and a finger acoustic isolator is an O-ring placed on the inside barrel.

5. The door latch assembly of claim 1, wherein at least one of said anvil acoustic isolator, said strike acoustic isolator, and a handle acoustic isolator is a resilient pad.

6. The door latch assembly of claim 1, wherein at least one of said acoustic isolators is constructed and arranged on the door latch assembly to dampen sound generated by the door latch assembly such that an increase in sound over ambient noise is less than 5 decibels.

7. The door latch assembly of claim 1, wherein at least one of said acoustic isolators is constructed and arranged on the door latch assembly to dampen sound generated by the door latch assembly such that an increase in sound over ambient noise is less than 12.5% of the ambient noise.

8. A door latch assembly with enhanced acoustic dampening characteristics, comprising:

a door bolt assembly including:

an inside barrel;

an outside barrel configured for accommodating spring biased linear reciprocal sliding action of the inside barrel between a latch position and a release position;

a strike operatively connected to said inside barrel for moving between said latch position and said release position;

an end plug secured to the outside barrel and configured to retain an end of a spring disposed within the inside barrel;

at least one barrel acoustic isolator secured to the inside barrel, and configured for dampening sound generated by said linear reciprocal action of said inside barrel relative to said outside barrel;

the at least one barrel acoustic isolator comprising a strike acoustic isolator secured on said strike and in contact with a first end of said inside barrel and an end plug acoustic isolator secured said end plug and in contact with said spring for sliding movement of said inside barrel relative to said outside barrel, and configured for dampening sound generated by said biasing of the inside barrel, said strike acoustic isolator and said end plug acoustic isolator being axially spaced along said inside barrel; and an anvil plate secured inside the inside barrel and having a finger-receiving surface;

a door handle assembly including:

a finger; and a door handle coupled to the finger such that the finger moves laterally along the axis of the inside barrel when the door handle is moved from a rest position to an actuating position;

a finger acoustic isolator secured around the finger and also around an associated fixed pin to exert a biasing force on, and to retain the finger when the door handle is in the rest position and configured for dampening sound generated by the finger moving laterally along the axis of the inside barrel;

said inside barrel is provided with an anvil acoustic isolator separate from said finger acoustic isolator and configured for receiving the finger at a finger-receiving surface of the anvil plate, said finger moving laterally along a longitudinal axis of said inside and outside barrels and impacting said anvil through said anvil acoustic isolator for retracting said strike.

9. The door latch assembly of claim 8, the door bolt assembly includes an anvil acoustic isolator fastened to a finger-receiving surface of the anvil plate and configured for dampening sound generated by the finger making contact with the anvil acoustic isolator.

10. A door latch assembly with enhanced acoustic dampening characteristics, comprising:

a door bolt assembly including;

a latch cylinder having a latch cylinder opening and a reciprocating strike;

a door handle assembly including:

a finger; and a door handle coupled to the finger such that the finger is moved in the latch cylinder opening when the door handle is moved from a rest position to an actuated position, the finger is configured for biasing the latch cylinder from a latch position to a release position; and at least one finger acoustic isolator configured for biasing said finger away from said release position, and at least one barrel acoustic isolator and at least one anvil further configured for dampening sound generated by the door latch assembly due to movement by all of the door handle, said finger, and said latch cylinder, said dampened sound being generated by reciprocal sliding action of an inside barrel relative to an outside barrel between a latch position and a release position caused by movement of said at least one handle assembly acting against a biasing force created by a return spring connected to said inside barrel, a pair of axially spaced acoustic isolators located on said inside barrel for isolating sound generated by said reciprocal action of said inside barrel relative to said outside barrel;

said sound also generated by impact of said finger on said anvil and being dampened by an anvil acoustic isolator fastened to a finger-receiving surface of the anvil plate and configured for receiving an end of said finger and dampening sound generated by the finger making contact with the anvil acoustic isolator, said finger moving laterally along a longitudinal axis of said inside and outside barrels;

said strike coupled to the inside barrel and having a shoulder recessed from an end of said strike said sound generated by impact of said strike against a dress plate being dampened by a strike acoustic isolator secured to the shoulder and configured for dampening sound generated by the strike making a generally planar contact which stops said linear reciprocating movement with said dress plate; and said door latch assembly is constructed and arranged to generate between 0.01 and 15 decibels over ambient noise.

* * * * *